US005277114A

United States Patent [19]

Witt

[11] Patent Number: 5,277,114

[45] Date of Patent: Jan. 11, 1994

[54] ACTIVE OPTICAL PROXIMITY FUSE

[75] Inventor: Bengt Witt, Karlskoga, Sweden

[73] Assignee: Bofors AB, Karlsokoga, Sweden

[21] Appl. No.: 906,889

[22] Filed: Jul. 6, 1992

[30] Foreign Application Priority Data

Jul. 4, 1991 [SE] Sweden ..... 9102088

[51] Int. Cl.[5] ..... F42C 13/02

[52] U.S. Cl. ..... 102/213

[58] Field of Search ..... 102/213, 211; 244/3.16

[56] References Cited

U.S. PATENT DOCUMENTS

| | | | |
|---|---|---|---|
| 3,786,757 | 1/1974 | Goldstein et al. | 102/213 |
| 4,232,609 | 11/1980 | Held | 102/213 |
| 4,269,121 | 5/1981 | Sochard | 102/213 |
| 4,309,946 | 1/1982 | Block | 102/213 |
| 4,532,867 | 8/1985 | Mitchell | 102/213 |
| 4,936,216 | 6/1990 | Skagerlund | 102/213 |
| 5,142,985 | 9/1992 | Stearne et al. | 102/213 |

*Primary Examiner*—Ian J. Lobo

[57] ABSTRACT

An active optical proximity fuse comprises a transmitter for transmitting a radiation lobe by means of which a target can be illuminated. A receiver receives radiation reflected from the target and images the target or an area of the latter as a spot on a surf ace belonging to a detector which emits at its outputs electrical signals which mutually vary depending on the position of the spot on the detector surface. The detector outputs are connected to first elements which emit a first signal depending on the position of the spot on the surface, the absolute value of which signal is greater with the position of the spot on first parts, preferably outer parts, of the surface than with the position of the spot on another part, preferably the center part, of the surface. Second elements (13) acting as arming elements compare the first signal with a predetermined reference and emit an arming signal ($i_A$) when two or more first signals, for example in the form of pulses, occur which exceed the reference. A third element forms a first reference signal ($V_{refi}$) which constitutes a part (fraction) of the first signal. A fourth element (14) acting as triggering circuit initiates a triggering signal when the arming signal ($i_A$) is present and when the said first element, after initiation of the arming signal, emits a first signal which drops below the said first reference signal ($V_{refi}$) and exceeds a second reference signal determined by the signal noise.

14 Claims, 2 Drawing Sheets $$X = L\,\frac{I_1 - I_2}{I_1 + I_2}$$

ACTIVE OPTICAL PROXIMITY FUSE

FIELD OF THE INVENTION

The present invention relates to an active optical proximity fuse which comprises a transmitter arranged to transmit a radiation lobe by means of which a target can be illuminated. The proximity fuse also comprises a receiver which receives radiation reflected from the target and images the target or an area of it as a spot on a surface of a detector which emits at its outputs electrical signals which mutually vary depending on the position of the spot on the detector surface.

BACKGROUND OF THE INVENTION

The present invention can be used in proximity fuses which utilize the base line principle. It is already known to use transmitters and receivers which operate with narrow radiation lobes. It is also known to make use of position-sensing detectors with which it is possible to define a position which corresponds to a certain predetermined target distance when the triggering signal is to be effected. Electrical signal processing devices which can be connected to the detectors for processing the electrical signals caused by the reflected radiation occur in different known embodiments.

In the type of equipment belonging to this category, it is essential that the proximity fuse can operate, with high accuracy and independently of the target characteristics (reflections, surface characteristics, and so forth).

SUMMARY OF THE INVENTION

The present invention has the aim of solving this problem, among others. It can therefore be considered to be the main characterising feature of the novel proximity fuse that, among other things, the outputs of the detector are connected to first elements which emit a first signal dependent on the position of the spot on the surface, the absolute value of which first signal is greater with the position of the spot on one or more first parts, preferably outer parts, of the surface than with the position of the spot on another part, preferably the center part, of the surface. The invention is also characterised by a second element acting as arming element which compare the first signal with a predetermined reference signal (fixed) and emits an arming signal when two or more first signals, for example in the form of pulses, occur which exceed the reference signal. When the equipment operates with a non-pulsating radiation, the first signal will alternatively exceed the reference for a predetermined duration. Further characteristics are that a third element forms a first reference signal which constitutes a part of the first signal and that a fourth element acting as triggering circuit emits a triggering signal with the arming signal present and in which the first element, after initiation of the arming signal, emits a first signal which drops below the first reference signal and exceeds a second reference signal determined by the signal noise.

In further developments of the concept of the present invention, the detector is of such a type in which the detector's surface is formed by a single element. In this case, the first element comprises amplifier and adding and subtracting elements for amplifying and forwarding the signal difference at the detector outputs to a filter also comprised in the first element and analog/digital converting elements. In this case, the first element comprises a dividing element connected to the last-mentioned part-element, which emits the first signal which is thereby a measure of the distance between the proximity fuse (ammunition unit) and the target.

In a second embodiment, a detector is utilized, the surface of which is formed by two elements. In this case, the outputs of the detector are connected to a differential amplifier comprised in the first element for amplifying the difference between the detector output signals. In this case, also, the first element contains filter and analog/digital conversion elements which emit the first signal as a measure of the distance from the target.

The transmitter and receiver are preferably of a type which operates with pulsed radiation, which entails that the first signal occurs in pulse form. In this case, the second element comprises a comparator which compares the first signal/pulses with the fixed reference signal. In a preferred embodiment, the second element operates with a two-pulse condition for emitting the arming signal. The third element can comprise a peak detector which receives the first signal, for example the highest pulse (amplitude) of the two or more pulses, and forms the part of the first signal.

The fourth element preferably comprises a window comparator which emits a signal when the first signal assumes a value between the first and second reference signals. The signal from the window comparator is supplied to a logic unit contained in the fourth element, which initiates the triggering signal when the said signal from the window comparator is present and at the same time an arming signal and clock pulse are present. The last-mentioned signal can be obtained from an OR-gate to which the output signal from the logic unit is connected. The OR-gate can comprise an input for an automatic triggering function where the signal processing equipment described above is shunted.

The present invention provides an effectively operating proximity fuse which is cost effective as compared with prior solutions. The proposed design can be constructed with known technology and known components available on the market. The proximity fuse is capable of withstanding very high accelerations and also withstands comparatively difficult steering and impact characteristics.

DESCRIPTION OF THE FIGURES

In the following, an embodiment presently proposed which exhibits the characterising features relevant to the present invention will be described with reference to the attached drawings, in which:

FIG. 8 shows in block diagram form the design of first elements in the signal processing circuit, the first elements being applicable to the detector according to FIGS. 6, 6a;

FIG. 9 shows a second embodiment of the first element, this element being applicable to the detector according to FIGS. 5, 5a;

PREFERRED EMBODIMENT

Figure 1:
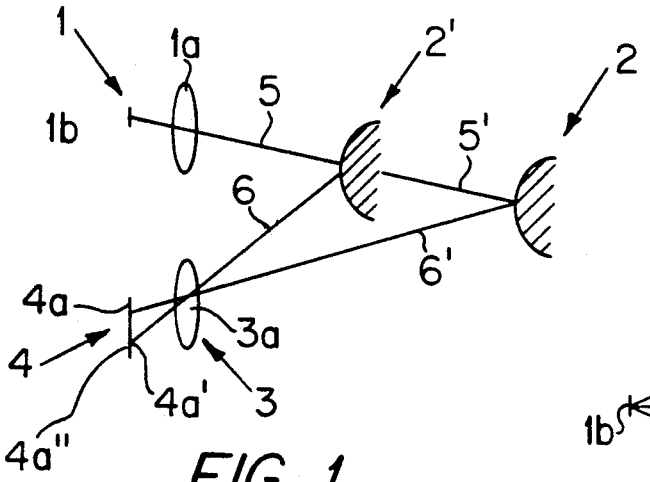
FIG. 1 shows in a basic diagram form an active optical proximity fuse of the present invention with position-sensing detector.
Figure 2:
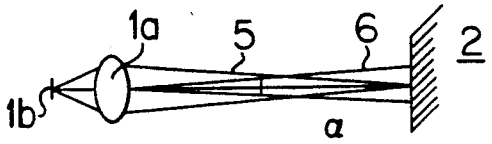
FIG. 2 shows in a basic diagram form the transmitter of the proximity fuse.
Figure 3:
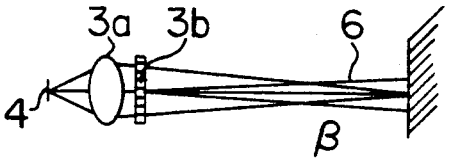
FIG. 3 shows in a basic diagram form the receiver of the proximity fuse.

The present invention can be applied to an ammunition unit, missile or projectile and so forth operating with a shaped charge. FIGS. 1-3 show the principles of an active optical proximity fuse which utilizes the base line principle. A transmitter 1 is arranged to illuminate with a narrow lobe a target against which the unit is moving in and which is shown in two different positions 2, 2'. The target reflects a proportion of the radiation/-light to a receiver 3. The receiver comprises a detector 4, and on its receiving surface 4a the target or a part of the target which is illuminated by the radiation is emitted as a glowing spot. The detector is such a design that it provides information about the location of the glowing spot on the surface 4a. By the detector being position-sensitive in this manner, a position on the detector can be defined which corresponds to a certain distance between the unit and the target where the effective part or equivalent of the unit will be triggered. The beam lobe from the transmitter is specified by 5, 5' and the reflected radiation by 6, 6'. The respective position of the spot on the detector surface is given by 4a', 4a''.

The transmitter 1 comprises a cast aspherical lens 1a in front of an edge-emitting light-emitting diode 1b. The transmitter produces a narrow well-defined lobe with angles of, for example, $0.3\times3°$. The focal length and diameter of the lens can be, for example, approximately 10 mm. The light-emitting diode emits at a wavelength of 870 nm. In the embodiment, this is pulsed with 20 kHz and a pulse ratio of 50%. The peak power from the transmitter can be selected to be approximately 40 MW at room temperature. The angles are represented by $\alpha$ in FIG. 2.

The receiver also comprises a lens 3a which is arranged together with an optical edge filter 3b. The filter absorbs light at a shorter wavelength than that of the transmitter. The lens images the target surface illuminated by the transmitter on a silicon photodetector or equivalent, see FIG. 3. As described below in the present invention, the detector can have different embodiments. The detector has a small active surface, for example $0.5\times0.3$ mm, to minimize noise due to solar illumination. The angle of the receiving lobe is specified by $\beta$.

Figure 4:
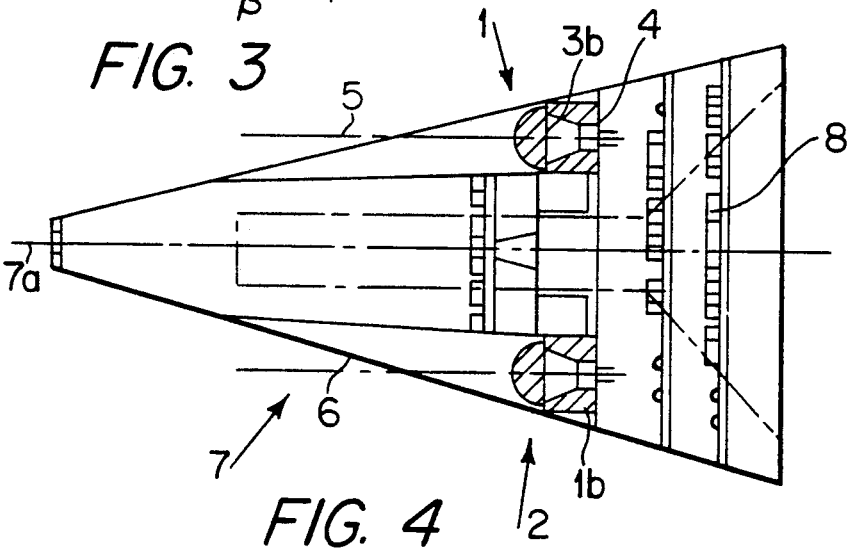
FIG. 4 shows a constructional embodiment of the proximity fuse arranged in a partly shown ammunition unit which operates with a shaped-charge function.

FIG. 4 shows the front parts of an ammunition unit (projectile, missile, and so forth) 7 which can be of a known type. The transmitter and receiver can be directed forward and the directions are shown by beam lobes 5, 6. The transmitter and receiver form a separate unit which can be trimmed and then mounted. The signal processing circuits described below are arranged on surface-mounting card 8 which is positioned across the longitudinal axis 7a of the unit 7. The light-emitting diode and photodetector are constructed of hermetically encapsulated components.

Figure 5:
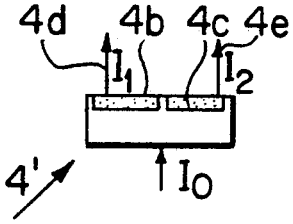
FIGS. 5–5*a* show in different views a first embodiment of a detector included in the proximity fuse.
Figure 5A:
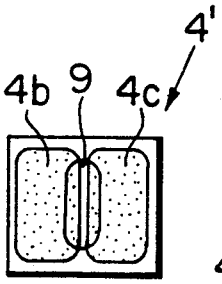

FIGS. 5, 5a show an example of a detector 4' which includes two elements 4b, 4c arranged closely together. The spot, or the illuminated area, is specified by 9. The detector is provided with two outputs 4d, 4e for electrical signals $I_1$ and $I_2$, respectively, which are generated in dependence on the position of the spot on the detector surfaces 4b, 4c. The detector is also designed with a feed input $I_0$ for energy supply to the detector.

Figure 6:
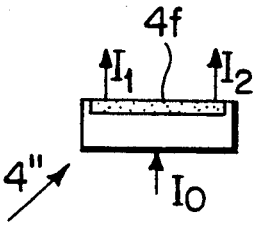
FIGS. 6–6*a* show in different views a second embodiment of the detector.
Figure 6A:
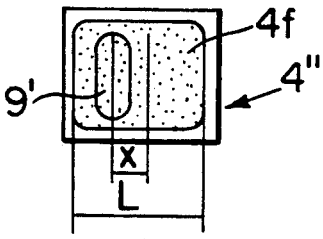

FIGS. 6, 6a show a second embodiment of the detector 4'', in which the detector's light-sensitive element 4f consists of a single part. In FIG. 6a, a center-to-center distance between the light or radiation-sensitive area 4f and the spot 9'' has been designated as x. The total length of the area 4f has been designated as L. The following mathematical relationship is given $$X = L\frac{I_1 - I_2}{I_1 - I_2}$$

Figure 7:
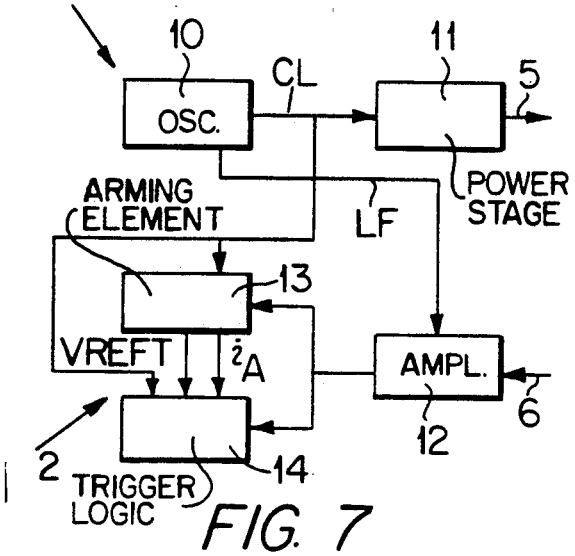
FIG. 7 shows in block diagram form the design of the signal processing circuit of the proximity fuse.

The transmitter and receiver electronics are shown in FIG. 7. The transmitter section is divided into an oscillator circuit 10 and a power stage 11. The oscillator provides the system clock frequency CL and a 4ocking clock frequency LF. The oscillator frequency is determined a known manner by means of an RC connecting stage. The power stage amplifies the signal CL and controls the current through the light-emitting diode. This outputs an optical pulse train with a pulse repetition frequency of 20 kHz and a pulse ratio of 50%.

The receiver comprise a receiver amplifier 12, an arming element 13 and a trigger logic unit 14. The receiver amplifier is different in the abovementioned detector alternatives, but the arming element 13 and trigger logic unit 14 are the same in both cases.

Figure 8:
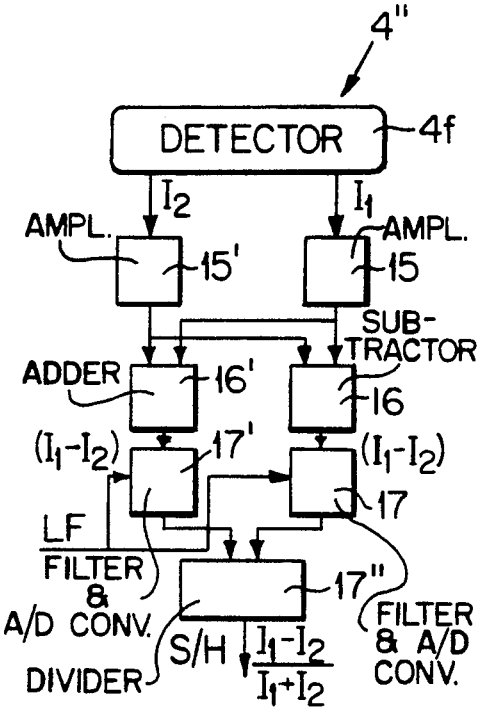

FIG. 8 shows the case with a linear detector. The respective outputs $I_1$ and $I_2$ are connected to one of the amplifiers 15 and 15', respectively. The outputs of the amplifiers are connected to subtracting and adding elements 16 and 16', respectively. There are also circuits 17, 17' which comprise bandpass filtering and analog/-digital conversion. The bandpass filter has a narrow band width and the center frequency is tuned to the clock frequency CL. In the analog/digital convertor, the peaks of the signal pulses are sampled and the function is controlled in a manner by the locking clock signal LF. The outputs of the circuits 17, 17' are connected to a divider, the output signal S/H of which represents a measure of the distance from the target. The divider provides the following output signal:

$$\frac{I_1 - I_2}{I_1 - I_2}$$

Figure 9:
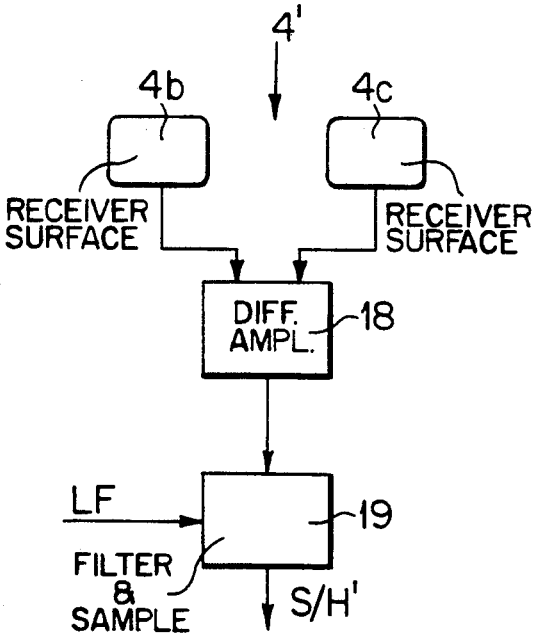

FIG. 9 shows the receiver amplifier design for the detector divided into two. In this case, the signals from the two elements 4b, 4c are supplied to a differential amplifier 18 which amplifies the difference between the signals. After that, the difference signal is bandpass-filtered and sampled in the circuit 19 which supplies the locking clock signal LF. In this case, the measure of the distance can be obtained directly from the circuit 19, the output signal of which is specified by S/H'.

Figure 10:
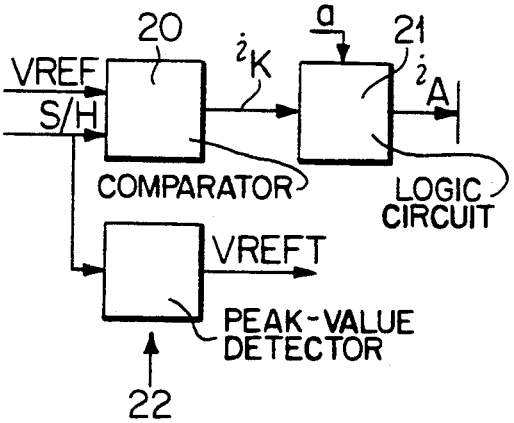
FIG. 10 shows in block diagram form second and third elements included in the signal processing circuit.

FIG. 10 shows the arming logic. This utilizes input signals $V_{ref}$ and S/H or, respectively, S/H' from the amplifiers according to FIGS. 8 and 9, respectively. The signals are supplied to a comparator 20. $V_{ref}$ has a predetermined fixed level. The signal $i_K$ from the comparator 20 is supplied to a first logic circuit 21 which is arranged to output an output signal in the form of an arming signal $i_A$ if the comparator has supplied two consecutive pulses $i_K$. This implies that the receiver must get two consecutive optical pulses (compare 6 in FIG. 7) above the $V_{ref}$ level for the ammunition unit (effective part) to be armed. In a third element 22 which can be constructed by a peak-value detector the signal SIB or, respectively, S/H' is locked. The highest signal (pulse) is preferably locked. A suitable fraction of the locked signal/pulse is used to form an output signal $V_{refi}$ from the detector 22. The last-mentioned signal consists of a reference signal which forms a level below which the signal must drop for the proximity fuse thereafter to provide a trigger signal or triggering signal after arming. When the proximity fuse (ammunition unit) approaches an actual target, the signal S/H or, respectively, S/H' from the divider 17'' or the circuit 19 (FIG. 9) will first be positive and increasing and then decrease and become negative. Ideally, the triggering signal will come when the signal S/H or, respectively, S/H' is zero. Since the proximity fuse is pulsed, it is not certain that the signal will assume the value zero.

Moreover, the signal amplitude will vary greatly for different target reflections and angles at the target surface with a given distance. The effect of different target characteristics can be minimized by setting the threshold $V_{refi}$ when the proximity fuse approaches the target.

Figure 11:
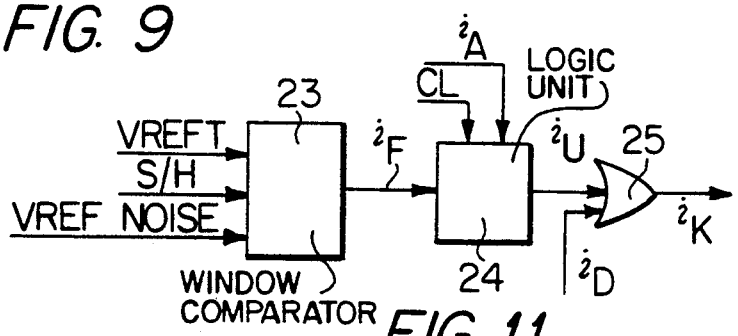
FIG. 11 shows in block diagram form a fourth element which is included in the signal processing circuit.

The trigger logic unit can be seen in FIG. 11. The trigger logic unit provides an output signal $i_T$ when the effective part will be triggered. The unit comprises a window comparator 23 and a second logic section 24 for checking whether the trigger condition is satisfied. The input signals to the window comparator are $V_{refi}$, S/H or, respectively, S/H' signals and $V_{refnoise}$ which consists of a second reference signal. The window comparator provides an output signal $i_F$ when the signal S/H or, respectively, S/H' is lower than $V_{refi}$ and greater than the second reference signal. The second reference signal has a fixed level which is determined by the noise in the S/H signal. The second reference signal is automatically determined in a known manner in the equipment. The signal $i_F$ from the window comparator is supplied to the logic section 24 which also has the arming signal $i_A$ and the clock signal CL as input signals. The logic unit 24 only initiates its output signal $i_T$ if these three signals are positive or negative at the same time. An OR circuit 25 receives the signal $i_T$ on one of its inputs which entails that the triggering signal $i_U$ is obtained at the output of the circuit 25. The circuit 25 can also be supplied with a signal $i_D$ for self-destruction. The latter can be desirable if an impact sensor provides a signal or a certain time has elapsed without the triggering condition having been satisfied (triggering signal $i_U$ occurs).

The light-emitting diode 1*b* (compare FIG. 1) is supplied with power by a thermal battery of, for example 5*a*, 18 V with center tap. The battery voltage can be stabilized at ±9 V+5 V.

The present invention is not limited to the embodiment shown as an example in the above, but can be subjected to modifications within the framework of the patent claims following and the concept of the invention.

I claim:

1. Active optical proximity fuse comprising:

a transmitter for transmitting a radiation lobe, for illuminating a target;

a receiver for receiving radiation reflected from the target and imaging the target or an area of the target as a spot on a surface of a detector said detector emitting at its outputs electrical signals which mutually vary depending on the position of the spot on the detector surface; and the detector outputs being connected to:

a) first means for emitting a first signal (S/H) dependent on the position of the spot on the detector surface;

b) second means for comparing the first signal (S/H) with a predetermined first reference signal ($V_{,ref}$) and emitting an arming signal ($i_A$) when at least two consecutive first signals, exceeding the first reference signal occur, or the first signal exceeds the first reference signal within a predetermined period;

c) third means for forming a second reference signal ($V_{refi}$) from a portion of the first signal; and d) fourth means acting as a triggering circuit for delivering a triggering signal ($i_U$) when the arming signal ($i_A$) is present and when the first means, after initiation of the arming signal, emit a first signal (S/H) which drops below the second reference signal ($V_{refi}$) and exceeds a third reference signal ($V_{refnoise}$) determined by the signal noise.

2. Proximity fuse according to claim 1, wherein the absolute value of the first signal is greater with the position of the spot on at least one first part, of the surface than with the position of the spot on another part.

3. Proximity fuse according to claim 2, wherein said first part is an outer part and said another part is a center part.

4. Proximity fuse according to claim 1, wherein the surface of the detector is formed by a single element and wherein said first means comprises amplifier and adding and subtraction elements for amplifying and forwarding the signal difference at the detector outputs, to a filter and analog/digital conversion elements which are also included in said first means, and wherein said first means also includes a dividing element which is connected to the analog/digital conversion elements and emits said first signal (S/H) which is a measure of the distance from the target.

5. Proximity fuse according to claim 1, wherein said surface of said detector is formed by two elements the outputs of which are connected to a differential amplifier, included in said first means, for amplifying the difference between the detector output signals, and wherein the first means also includes filter and analog/digital conversion elements which emit said first signal (S/H') which is a measure of the distance from the target.

6. Proximity fuse according to claim 1, wherein the transmitter and the receiver operate with pulsed radiation so that the first signal (S/H, S/H') occurs in pulse form, and wherein the second means includes a comparator which compares said first signal pulses with said first reference signal ($V_{ref}$), and wherein the second means operates with a multi-pulse condition for emitting the arming signal ($i_A$).

7. Proximity fuse according to claim 6, wherein said third means includes a peak value detector which receives said first signal, in said pulse form and from the highest pulse of the at least two of said first signals forms said second reference signal ($V_{refi}$).

8. Proximity fuse according to claim 1, wherein said fourth means includes a window comparator which emits a signal ($i_F$) when said first signal (S/H, S/H') assumes a value between said second and third reference signals ($V_{reft}$ and $V_{refnoise}$, respectively).

9. Proximity fuse according to claim 8, wherein said fourth means includes a logic unit for producing said triggering signal ($i_U$) upon receiving the signal ($i_F$) from the window comparator and when at the same time the arming signal ($i_A$) and clock pulse (CL) are present.

10. Proximity fuse according to claim 9, wherein the output of said logic unit is connected to an OR-gate to which a signal coming from the logic circuit can be connected, and wherein the OR-gate includes an input for an automatic triggering function.

11. Proximity fuse according to claim 9, wherein said window comparator is connected to a logic unit and the output of said logic unit is connected to an OR-gate and wherein the OR-gate also includes an input for an automatic triggering function.

12. Proximity fuse according to claim 5, wherein the transmitter and the receiver operate with pulsed radiation so that the first signal (S/H, S/H') occurs in pulse form, and wherein said second means includes a comparator which compares the first signal pulses with said reference signal ($V_{ref}$), and wherein the second means operates with a multi-pulse condition for emitting the arming signal ($i_A$).

13. Proximity fuse according to claim 5, wherein said fourth means includes a window comparator which emits signals ($i_F$) when the first signal (S/H, S/H') assumes a value between said second and third reference signals ($V_{reft}$ and $V_{refnoise}$, respectively).

14. Proximity fuse according to claim 6, wherein said fourth means includes a window comparator which emits signals ($i_F$) when the first signal (S/H, S/H') assumes a value between said first, second and third reference signals ($V_{reft}$ and $V_{refnoise}$, respectively).

* * * * *